US006626593B2

(12) United States Patent
Doberenz

(10) Patent No.: US 6,626,593 B2
(45) Date of Patent: Sep. 30, 2003

(54) PEN PRINTER

(75) Inventor: Philip Wayne Doberenz, Tigard, OR (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 09/978,445

(22) Filed: Oct. 16, 2001

(65) Prior Publication Data

US 2003/0071863 A1 Apr. 17, 2003

(51) Int. Cl.[7] ..... B41J 3/36

(52) U.S. Cl. ..... 400/88; 400/279; 347/109; 345/157; 345/163

(58) Field of Search ..... 400/279, 88; 358/1.1; 345/163, 157; 346/143; 347/109

(56) References Cited

U.S. PATENT DOCUMENTS 4,949,283 A * 8/1990 Yamauchi et al. ..... 346/143
5,311,208 A * 5/1994 Burger et al. ..... 345/157
5,355,146 A * 10/1994 Chiu et al. ..... 345/156
5,634,730 A * 6/1997 Bobry ..... 346/143
5,825,995 A * 10/1998 Wiklof et al. ..... 358/1.18
5,853,251 A * 12/1998 Imai ..... 347/109
5,927,872 A * 7/1999 Yamada ..... 400/88
6,350,071 B1 * 2/2002 Conwell et al. ..... 347/102
6,398,432 B1 * 6/2002 Day et al. ..... 346/143

OTHER PUBLICATIONS

PCT International Search Report (PCT/US 02/32884) International Filing Date: Oct. 15, 2002 Priority Date: Oct. 16, 2001 Applicant: Intel Corporation.

* cited by examiner

*Primary Examiner*—Andrew H. Hirshfeld
*Assistant Examiner*—Minh Chau
(74) *Attorney, Agent, or Firm*—Marger Johnson & McCollom, PC

(57) ABSTRACT

A printing system. The system may include an ink dispenser, a switch to generate an initial position signal, a movement sensor to generate movement signals and a circuit that causes the dispenser to dispense ink in accordance with the image data, the initial position signal and the movement signal. The system may also include a connector, a power source, a microcontroller, a memory and an ink-curing component. Image data is then transferred to a surface by sweeping the printing system across the surface as the printing system tracks the status of each pixel.

12 Claims, 3 Drawing Sheets

FIGURE 1
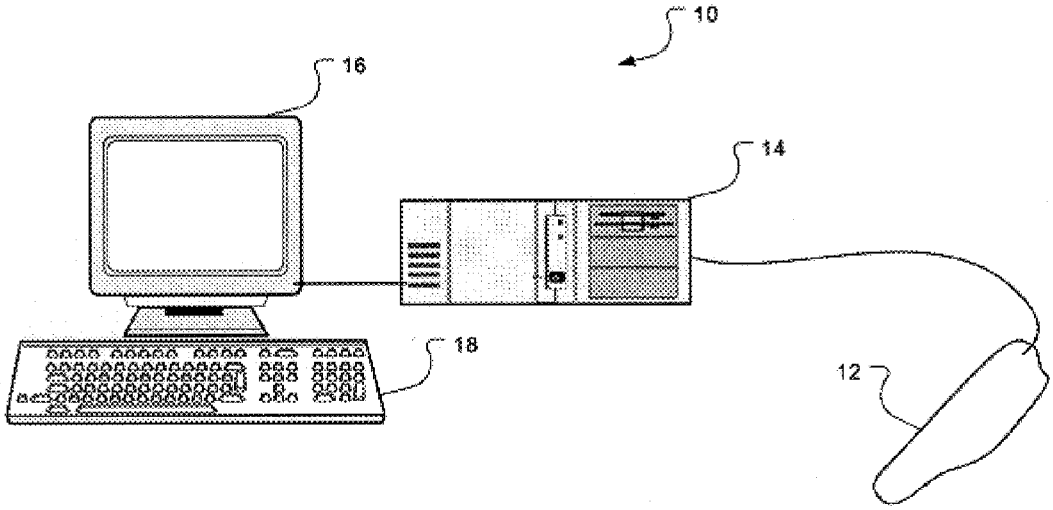
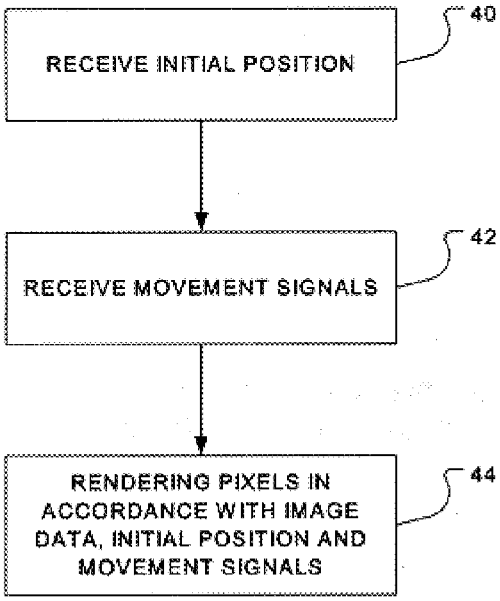
FIGURE 5

FIGURE 2
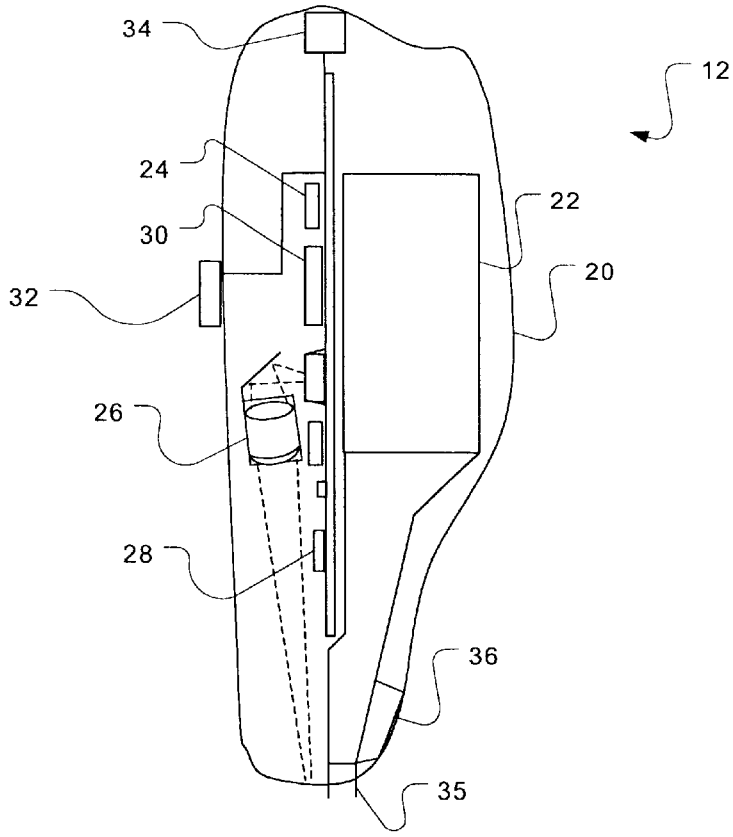
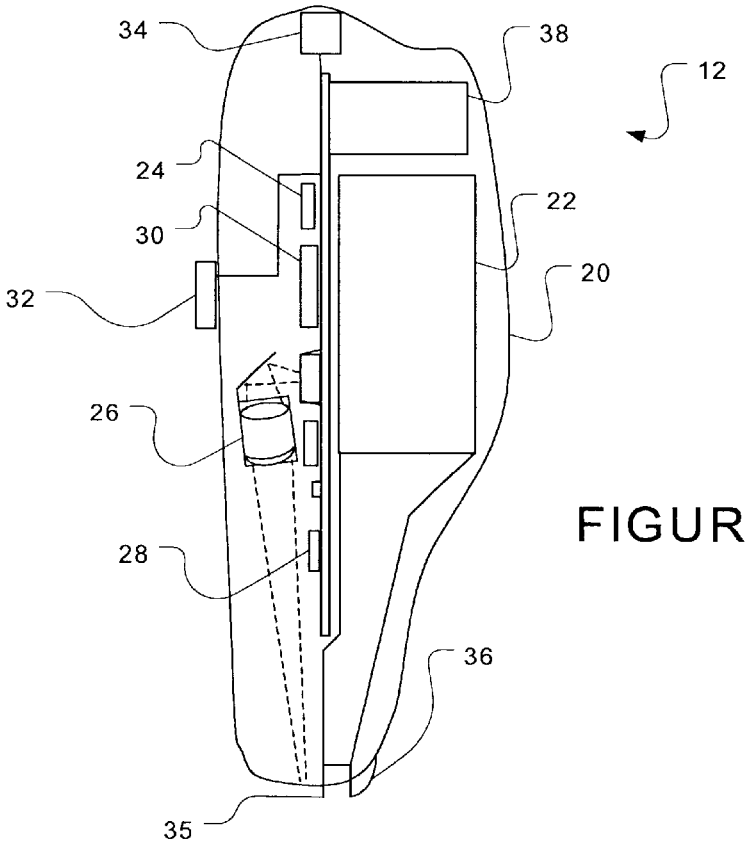
FIGURE 3

PEN PRINTER

BACKGROUND

1. Field

This disclosure relates to printing systems, more particularly to printing systems without fixed print heads.

2. Background

Printing systems have become very common computer peripherals. A printing system, or printer, typically has a case in which is contained the print head, the electronics which control the movement of the print head, and the ink supply that forms the visible images from the patterns created by the print head. The case also typically contains the various accessories that allow the printer to function; including paper feed rollers, power supplies, and the control panel, if any. In the case of toner-based printers, there will typically also be an optical photoreceptive substrate, such as a roller or belt that receives light patterns that are then converted to images by the toner, and fusers for fusing the toner onto the paper.

Generally, print systems have print heads that move in a linear fashion, with the image being created as the paper is scanned by the print head. Each time the print head traverses the paper or other print substrate, a line of the image is created. The fixed path of the print head provides a stable platform for image formation. Without it, the image may have objectionable artifacts, such as uneven characters on a line.

However, the fixed path of the print head limits applications of printers, such as on uneven surfaces or those surfaces that cannot be put inside a printer case. The casing in which the print head is contained can also limit the sizes of the substrates upon which printing is desired. Specialized printers can be purchased for printing items smaller than business cards and larger than posters and blueprints, but the printer limits the average user.

It would be useful to have a printer that is not limited to a particular application, substrate size, or surface characteristic, while still allowing accurate rendering of images.

BRIEF DESCRIPTION OF THE DRAWINGS

The invention may be best understood by reading the disclosure with reference to the drawings, wherein:

FIG. 1 shows an embodiment of a computing system with a printing system peripheral, in accordance with the invention.

FIG. 2 shows an embodiment of a printing system, in accordance with the invention.

FIG. 3 shows an alternative embodiment of a printing system, in accordance with the invention.

FIG. 5 shows a method for reproducing an imaging using a printer without a printer head, in accordance with the invention.

DETAILED DESCRIPTION OF THE EMBODIMENTS

Figure 4A:
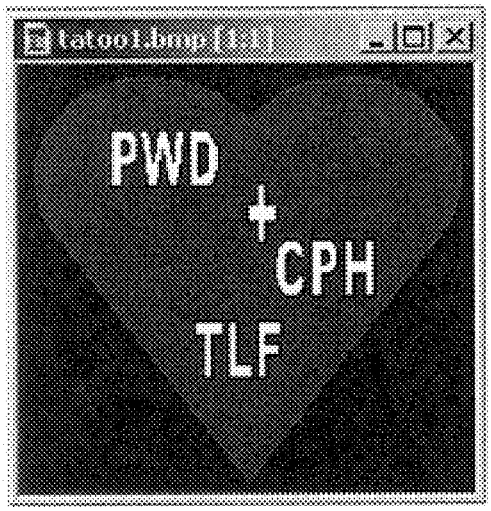
FIGS. 4*a* and 4*b* show an example of an image to be printed, and the image as being printed, in accordance with the invention.

A computing system having a printer peripheral is shown in FIG. 1. The system 10 shown in FIG. 1 is similar to a traditional desktop configuration, but the computing system may be of any type that requires printed output. Generally, a computing system 10 with a printer peripheral 12 will typically comprise a main central processing unit 14, and a user interface, including a display 16 and some form of inputs 18. These are only intended as examples and are not intended to limit scope of the application in any way. The printing system 12 may be configured to stand alone, for example.

An embodiment of the printing system 12 is shown in FIG. 2. In this example, the printing system comprises a casing 20, which contains an ink dispenser 22, a circuit 24 that controls the ink dispenser, a switch 32, and a movement sensor 26. The printing system may also include a memory 30, a power source 38, a microcontroller 28, and ink-curing component 36 and a connector 34, as is shown in FIGS. 2 and 3.

These components may be combined in several different configurations. For example in FIG. 2, the printing system 12 receives image data through the connector 34. The connector may be one of many different types, such as a universal serial bus (USB) connector, a generic serial connector such as is commonly used with a mouse, an infrared connector or a parallel connector. The image data may or may not be stored by a memory 30, depending upon the speed of the connection and the speed of the print drive electronics in converting the image data signals into ink sprayed out the nozzle. The image data will more than likely be generated by a computing system, such as the one shown in FIG. 1. Typically, even with image data generated from the computing system, a buffer memory would be used to store data until it can be processed. Alternatively, the image data may be downloaded in its entirety from a network directly into a memory 30.

Once the image data is provided, the print drive circuit 24 converts it into the necessary control signals to operate the ink dispenser. This may or may not include a microcontroller 28 for finer controller of the electronics or addition of special print processes. The user positions the printing system in the appropriate place. Looking now at FIG. 4*a*, the origin, or initial position, may be any place designated by the system designer. For purposes of this discussion, the initial position will be deemed to be the upper left corner of the image shown, as it would be viewed in a 'window' on a computer system.

When the user has positioned the printing system in the appropriate spot, an initial position switch is triggered. In the example of FIG. 2, the initial position switch 32 may be situated on the outside of the casing 22 in a location convenient to the user's fingertips. Alternatively, the initial position switch 32 could be positioned on the tip of the printing system, near the nozzle 35. The user would then trigger the switch by pressing down with a little extra force to locate the origin. The user triggers the switch to start the printing. The user then sweeps the printing system across the surface to be printed.

Figure 4B:
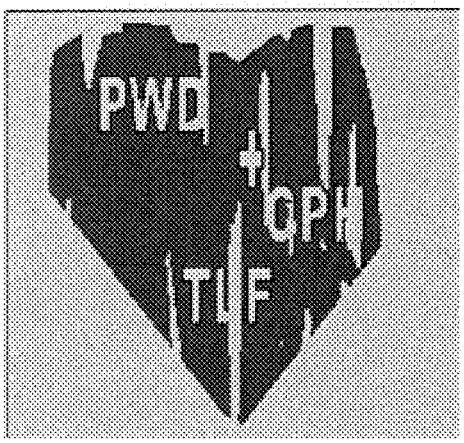

The movement sensor 26 tracks the movement of the printing system. This ensures that the printing system dispenses the ink correctly, only where the ink is intended to go. For example, with an irregular surface, the user may move the system faster or slower over different parts of the image. The positional feedback from the sensor ensures that the pixels (picture elements) are printed in the correct position, rather than just printing the next pixel in order, regardless of where the printing system is positioned. This also allows the user to make successive passes of the system over the surface to be printed, such as to fill in the gaps seen in FIG. 4*b*.

In one embodiment the movement sensor 26 may be an optical mouse engine, possibly modified slightly to provide more accurate signals than those typically provided by an optical mouse engine. Other types of movement sensors may also be used, such as radio-frequency (radio) tags queried from a base station in the computing system, infrared sensors, etc. Optical mouse engines have some advantages in that they are relatively inexpensive and readily available. However, the selection of the movement sensor is left up to the system designer. In another embodiment, two or more movement sensors may be used to track rotation or movement in three dimensions, rather than just on an x-y grid as is possible with one movement sensor.

The sensor allows the user to sweep the printing system across the surface upon which the image is to be printed. The printing system has access to some sort of intelligence that allows it to determine if a pixel at a given position has been printed. In this manner, as the user sweeps the printing system across the surface, the system tracks the position and prints the pixel. Once a particular pixel has been printed, the image data corresponding to that pixel will be deleted from the image memory, wherever the image memory resides.

An embodiment of such a process is shown in flowchart form in FIG. 5. The user triggers the switch when the printing system is at the origin point for the image. The exact location of the origin is left to the system designer. This causes the printing system to receive an initial position signal at 40. As the user sweeps the printing system across the area of the surface to be printed, the printing system receives movement signals at 42. If an embodiment of the printing system is used that has more than one movement sensor, the movement signals may be translated into rotational signals to add to the rendering status of the pixels, as will be discussed further.

The printing system then uses the movement signals, the initial position signal and the image data to render pixels at 44. The movement signal and the initial position signal allow the intelligence in the system to determine the printing system position relative to the origin.

In addition, the system may track the rendering status of a pixel, where the rendering status is whether or not the pixel has been printed. Once a pixel is printed, for example, the data for that pixel may be deleted from memory. The system would then conclude that the rendering status for that pixel is 'rendered.' The printing system will continue to print pixels that have the status of 'not rendered' even if all of the neighboring pixels have been rendered. The status of the pixels may take into account the rotation of the printing system, as it may indicate more accurately whether a particular pixel may not have been rendered due to the rotation of the system.

The intelligence to which the printing system has access may reside in the printing system or may be part of the computing system. The printing system may be a 'dumb' peripheral in that a computing system to which it may be attached would send the signals necessary to cause the circuit 24 to send the appropriate commands to the ink dispenser 22. Alternatively, the printing system may have a microcontroller 28 that provides the intelligence as to which pixels have already been printed. In yet another alternative, the printing system could stand alone with the microcontroller function performed by a processor such as a digital signal processor or general-purpose central processing unit. The term microcontroller, as applied to component 28, will include microcontrollers, digital signal processors, central processing units and equivalent devices.

The print drive circuit, with or without the microcontroller 28, may control the ink dispenser 22 to cause it to place ink on the surface to form the image. The term ink, as used here, includes any material that may be sprayed onto a surface the causes an image to be visible, either by the naked eye or by specialized equipment. For example, the ink dispenser may spray or otherwise dispense a material that is only detectable when exposed to ultraviolet (UV) lights, similar to hand stamps used at entries to events or arenas. The person having the stamp cannot see the stamp until the hand is placed under a UV light, at which time the stamp becomes visible. Similarly, the term ink may include gels, powders, suspensions, etc., that may not typically be included in the term 'ink.'

Typically, the printing system will have to remain in contact with the surface until the entire image is filled in. This may include subsequent passes over previously printed pixels, as missed pixels are printed. This allows the movement sensor to track the movement of the device. In this case, the ink must be some sort of fast-drying ink, or a curing component 36 may be needed. If the movement sensor does not require contact to track motion, no ink-curing component 36 may be needed.

If an ink-curing component is needed, the component could be something such as a UV light bulb, or a previously dispensed chemical that causes the ink to dry on contact. The embodiment shown in FIG. 2 shows a chemical dispenser 36 mounted such that the chemical is dispensed just before the ink, causing the ink to dry on contact. Alternatively, the user could dispense the chemical from a spray bottle or from a pre-treated wipe, as further examples. In FIG. 3, the embodiment shown has a UV light bulb 36 that cures the ink, allowing it to be contacted without smearing.

As mentioned previously, the printing system can be configured in several different ways. FIGS. 2 and 3 show alternative embodiments merely as examples of possible configurations. The embodiment of FIG. 2 would rely upon the connection with a computer system through the connector 34 for both power and data. The embodiment of FIG. 3 may rely upon a computer system for data, but has a power source 38, typically a battery although it could also be an AC adapter. As mentioned previously, the printing system could be a fairly independent system, using the connector as a network peripheral, downloading image data from a network or file server, rather than from a computer system. This embodiment may also require some sort of user interface, not shown.

Similarly, the embodiment of FIG. 3 has an ink-curing component 36 that comprises a UV light bulb. The embodiments of FIGS. 2 and 3 may also differ with respect to the microcontroller 28, the size of the memory 30, the type of ink used in the ink dispenser 22, etc.

Thus, although there has been described to this point a particular embodiment for a method and apparatus for a pen printer, it is not intended that such specific references be considered as limitations upon the scope of this invention except in-so-far as set forth in the following claims.

What is claimed is:

1. A printing system, comprising:

a dispenser of ink;

a switch to allow a use to generate an initial position signal;

at least one movement sensor to generate at least one movement signal;

a memory to store image data;

a microcontroller to:

convert the image data, initial position signal and movement signal to control signals for an ink dispenser; and track a rendering status of each pixel, such that image data corresponding to rendered pixels are deleted from the memory; and a circuit to cause the dispenser to dispense ink in accordance with the control signals.

2. The printing system of claim 1, wherein the system further comprises a connector to connect the system to a source of image data.

3. The printing system of claim 1, wherein the system further comprises a power source.

4. The printing system of claim 1, wherein the printing system further comprises an ink-curing component.

5. The printing system of claim 4, wherein the ink curing component further comprises one of the group comprised of: an ultraviolet light source, and a chemical curing agent dispenser.

6. The printing system of claim 1, wherein the switch further comprises a pressure switch.

7. The printing system of claim 1, wherein the movement sensor further comprises one of the group comprised of: an optical position sensor, and a radio position sensor.

8. The printing system of claim 1, wherein the movement sensor further comprises more than one movement sensor.

9. A method of rendering image data, comprising:

identifying an initial position of an ink dispenser from a user input made at the ink dispenser;

receiving movement signals, wherein the movement signals indicate movement of the ink dispenser;

Storing the image in a memory;

rendering pixels corresponding to image data, wherein the pixels are rendered according to the corresponding image data, the initial position and the movement signals; and tracking the rendering status of each pixel, such that image data corresponding to rendered pixels are deleted from the memory.

10. The method of claim 9, wherein identifying an initial position further comprises receiving signals from a switch and a position sensor.

11. The method of claim 9, wherein the method further comprises rendering pixels with a rendering status of not rendered anywhere in an image grid regardless of the rendering status of neighboring pixels.

12. The method of claim 9, wherein receiving movement signals further comprises receiving movement signals from more than one movement sensor, and translating the movement signals into rotations movement signals.

* * * * *

UNITED STATES PATENT AND TRADEMARK OFFICE

CERTIFICATE OF CORRECTION

PATENT NO. : 6,626,593 B2
DATED : September 30, 2003
INVENTOR(S) : Doberenz

It is certified that error appears in the above-identified patent and that said Letters Patent is hereby corrected as shown below:

Column 4,
Line 62, “allow a use to” should read -- allow a user to --.

Column 6,
Line 13, “from the memory.” should read -- from the image data. --.

Signed and Sealed this

First Day of June, 2004

JON W. DUDAS
*Acting Director of the United States Patent and Trademark Office*